US007281279B2

(12) United States Patent
Shieh

(10) Patent No.: US 7,281,279 B2
(45) Date of Patent: Oct. 16, 2007

(54) DRAIN VALVE

(75) Inventor: Ching-chen Shieh, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 401 days.

(21) Appl. No.: 11/072,471

(22) Filed: Mar. 7, 2005

(65) Prior Publication Data

US 2006/0195977 A1 Sep. 7, 2006

(51) Int. Cl.
*E03D 1/35* (2006.01)

(52) U.S. Cl. ..... 4/403

(58) Field of Classification Search ..... 4/392–395, 4/403–404

See application file for complete search history.

(56) References Cited

U.S. PATENT DOCUMENTS 4,189,795 A * 2/1980 Conti et al. ..... 4/324
4,497,076 A * 2/1985 Sullivan ..... 4/392
5,390,375 A * 2/1995 Fernstrum, Jr. ..... 4/404
6,173,457 B1 * 1/2001 Higgins ..... 4/393
6,381,765 B1 * 5/2002 Liu ..... 4/404

* cited by examiner

*Primary Examiner*—Charles E. Phillips
(74) *Attorney, Agent, or Firm*—Troxell Law Office, PLLC

(57) ABSTRACT

A drain valve, which is assembled on a rotating element of a water tank, is adapted to cooperate with a handle and a link element of the water tank for controlling opening or stopping a drain hole of the water tank. The drain valve includes a fixing base, a cover above the fixing base, a float below the fixing base, and a stop pad between the cover and the fixing base. The fixing base forms outer screw threads on an outer peripheral of a lower portion thereof. A plurality of vent holes being distributed at an outer peripheral of a bottom of the fixing base. The float defines inner screw threads on an inner peripheral of an upper portion thereof for engaging with the outer screw threads of the fixing base thereby adjusting width of the vent holes. The drain valve controls water draining time and stopping time and effectively saves water. In addition, the drain valve is adapted for all types of toilet water tank and is assembled easily.

7 Claims, 6 Drawing Sheets

DRAIN VALVE

BACKGROUND OF THE INVENTION

1. Field of the Invention

The present invention relates to a drain valve, and particularly to a drain valve which is mounted on a toilet water tank to control water and which is water-saving and is adapted for all types of water tanks.

2. Related Art

Nowadays toilet water tanks are popularly used to reserve water for flushing toilet bowls. Drain valves are provided in the water tanks. By operating activating elements, the drain valves are driven to control water flowing out of water tanks for flushing the toilet bowls.

As shown in FIG. 8, a conventional drain valve 40 comprises a cover 41. A lift portion 411 is formed on the top of the cover 41. A chain 42 has an end coupled with the lift portion 411 and another end coupled with a link pole 52 of a handle 51 above a water tank 50. A pair of support arms 412 is formed on an edge of the cover 41 and parallel to each other. Each support arm 412 defines a notch 413 at a bottom thereof for clamping a rotating element 531 of an overflow tube 53 in the water tank 50.

A float 43 is provided below the cover 41, and a stop pad 44 is formed between the float 43 and the cover 41. A flow hole 431 is defined at center of a bottom of the float 43 for allowing water in or out. A vent hole 432 is defined at a top of the float 43.

The handle 51 is activated to open the cover 41, and the preserved water in the water tank 50 flows out from the drain hole 54. At the same time, the preserved water also flows through the flow hole 431 and into the float 43. Subsequently, interior air in the float 43 is pulled out from the vent hole 432 by water. When weight of water in the float 43 reaches a predetermined value, the cover 41 pivots and stops the drain hole 54, and the water tank begins to preserve water therein.

The drain valve 40 can control water flowing or stopping. However, width of the vent hole 432 can not be adjusted, and the air in the float 43 is pulled out at fixed velocity. It is uncontrollable when the cover 41 pivots to stop the drain hole 54. So it is as well uncontrollable how much water in the water tank 50 is drained. Such a conventional drain valve does not save water and is uneconomical.

SUMMARY OF THE INVENTION

Accordingly, an object of the present invention is to provide a drain valve which controls water draining time and stopping time and which effectively reduces water consumption.

Another object of the present invention is to provide a drain valve which is adapted for all types of toilet water tanks and which is conveniently assembled and adjusted.

The drain valve of the present invention comprises a fixing base, a cover above the fixing base, a float below the fixing base, and a stop pad between the cover and the fixing base. The fixing base forms outer screw threads on an outer peripheral of a lower portion thereof. A plurality of vent holes is distributed at an outer peripheral of a bottom of the fixing base. A plurality of flanges extends upwardly from an inner edge of the fixing base. Each flange forms an anchor outwardly for positioning the cover. The float defines inner screw threads on an inner peripheral of an upper portion thereof for engaging with the outer screw threads of the fixing base thereby adjusting width of the vent holes.

DESCRIPTION OF THE PREFERRED EMBODIMENTS

Figure 4:
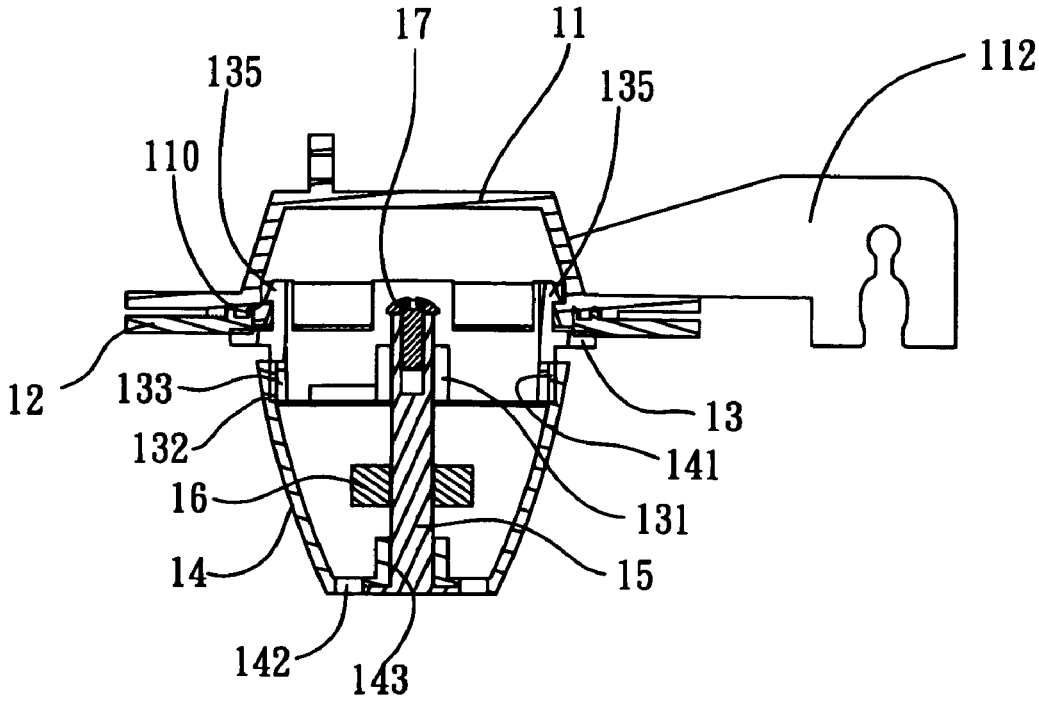
FIG. 4 is similar to FIG. 3, wherein the drain valve has not been adjusted.
Figure 5:
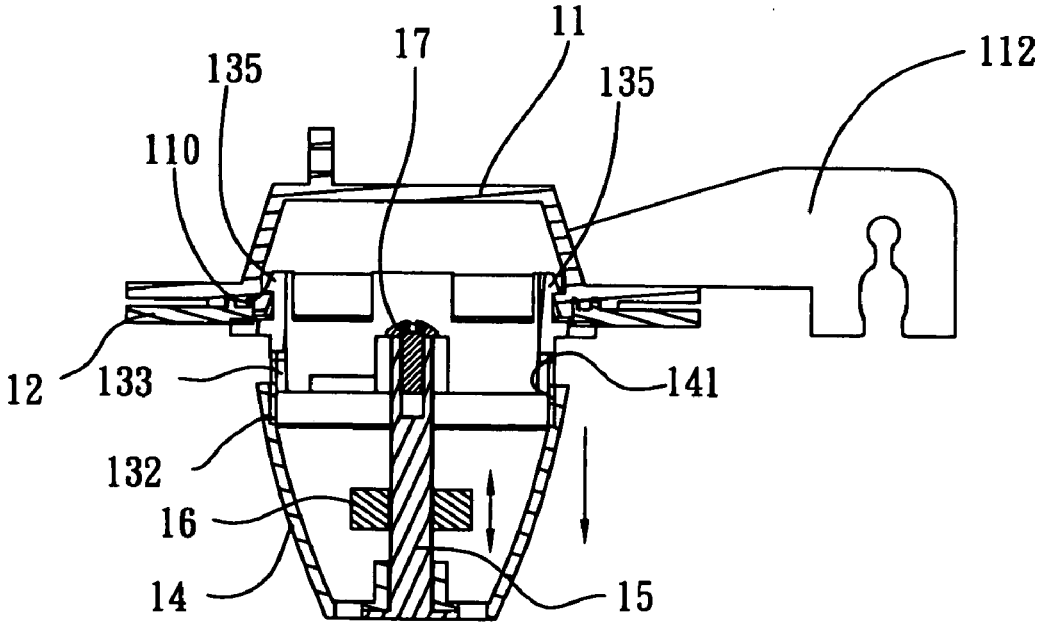
FIG. 5 is similar to FIG. 3, wherein the drain valve has been adjusted.
Figure 6:
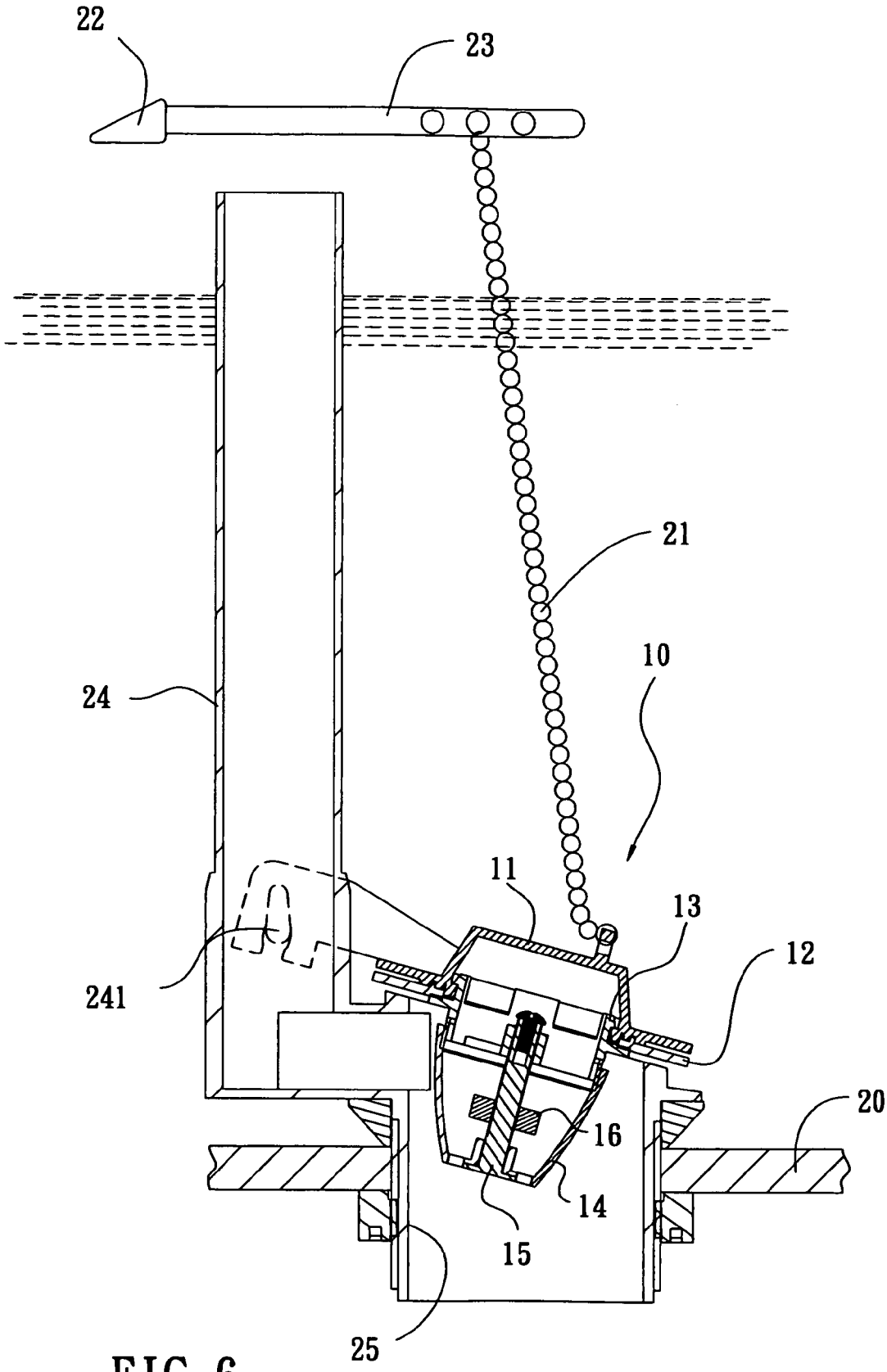
FIG. 6 is a cross-sectional view of the drain valve of FIG. 3 with a water tank, wherein the drain valve is closed.
Figure 7:
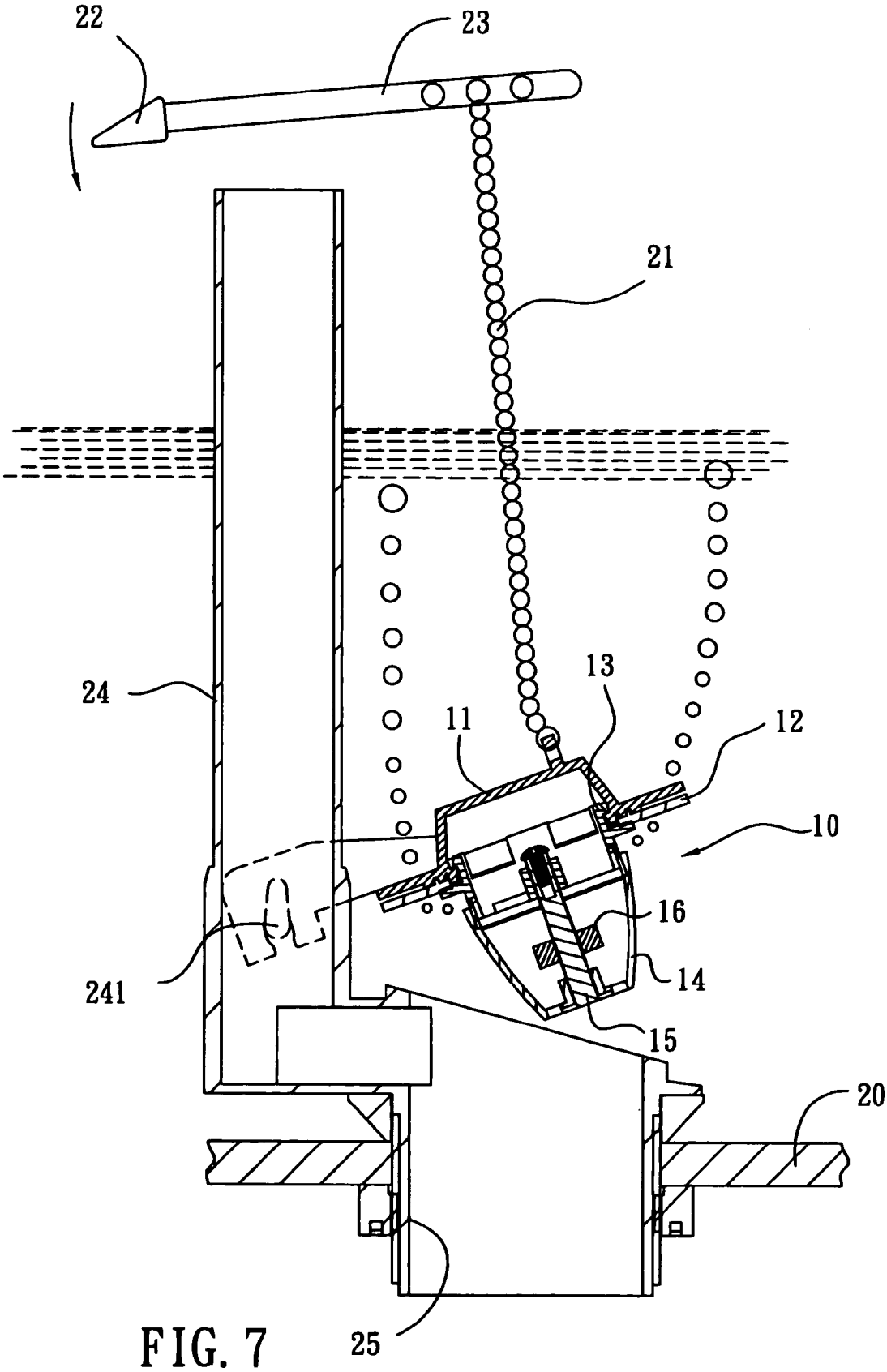
FIG. 7 is a cross-sectional view of the drain valve of FIG. 3 with a water tank, wherein the drain valve is opened.
Figure 8:
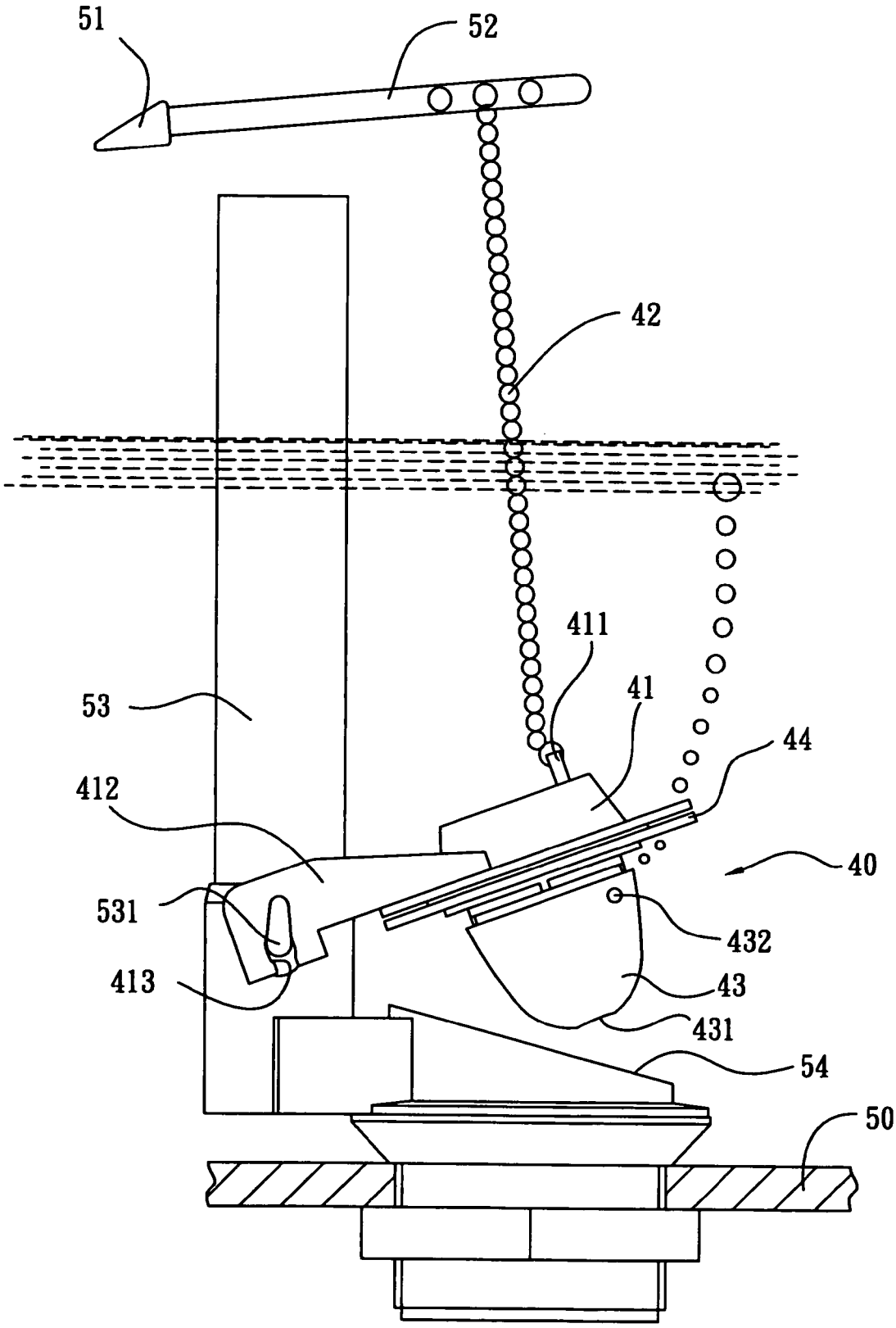
FIG. 8 (Prior Art)
FIG. 8 is a cross-sectional view of a conventional drain valve, wherein water is being drained.

With reference to FIGS. 1 to 7, a drain valve 10 in accordance with the present invention comprises a cover 11, a stop pad 12, a fixing base 13, a float 14, a fixing axis 15, a weight block 16 and a bolt 17. The cover 11 has an inner surface and an outer surface. A positioning flat 110 (showing in FIGS. 3 and 4) is formed at the inner surface. A lift portion 111 projects at the outer surface and connects with a link element of a water tank 20. In this embodiment, the link element is a chain 21. The chain 21 has an end connecting with the lift portion 111, and another end fixed on a link pole 23 of a handle 22 on the water tank 20. A pair of support arms 112 is formed in parallel at the outer surface and extends beyond the cover 11. Each support arm 112 defines a notch 113 at a bottom thereof for clamping a rotating element 241 of an overflow tube 24 on the water tank 20 (as shown in FIG. 6).

The stop pad 12 is soft and hollow, and is mounted between the cover 11 and the fixing base 13 for covering a drain hole 25 of the water tank 20.

Figure 1:
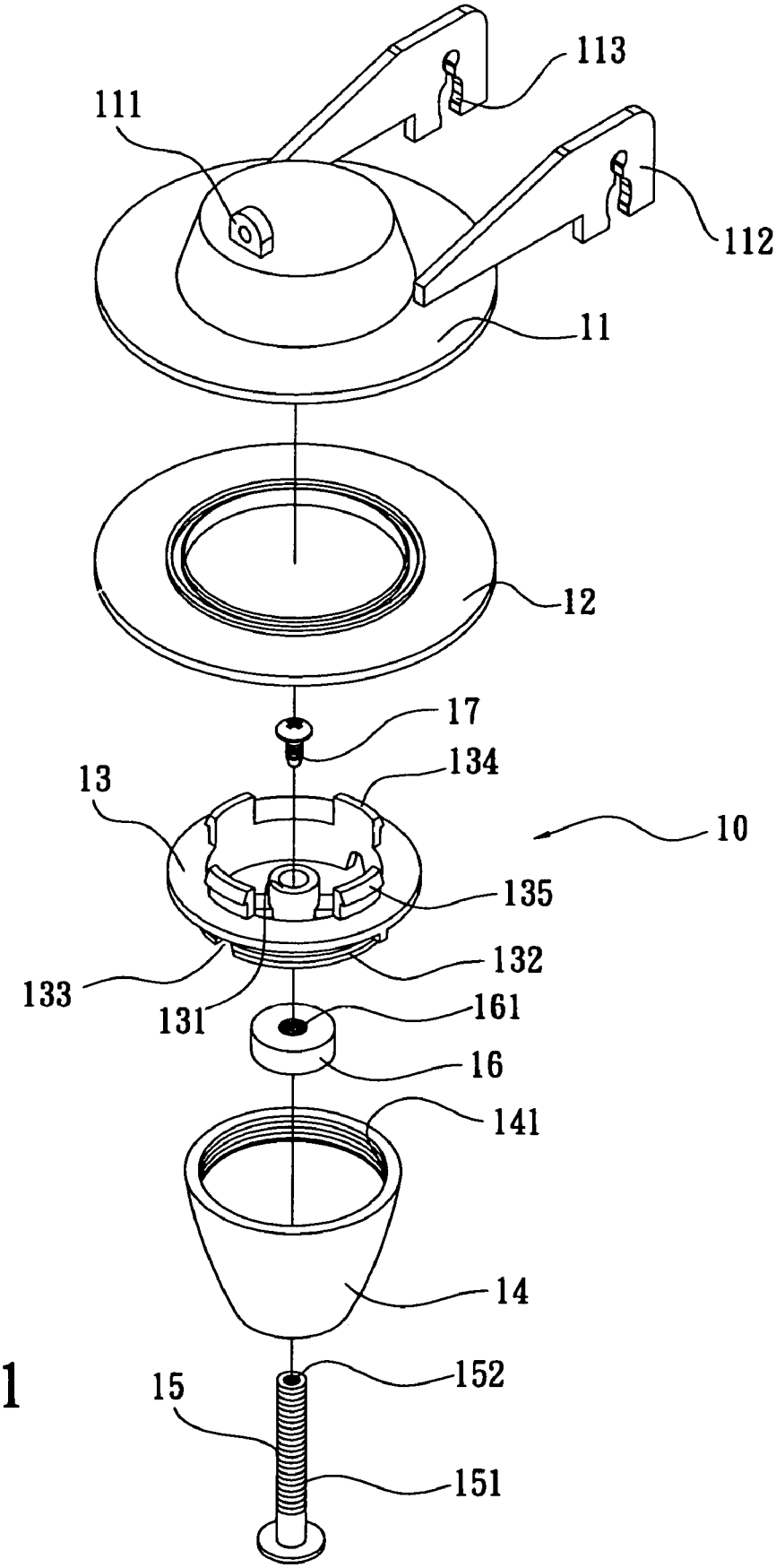
FIG. 1 is an exploded view of a drain valve according to the present invention.
Figure 2:
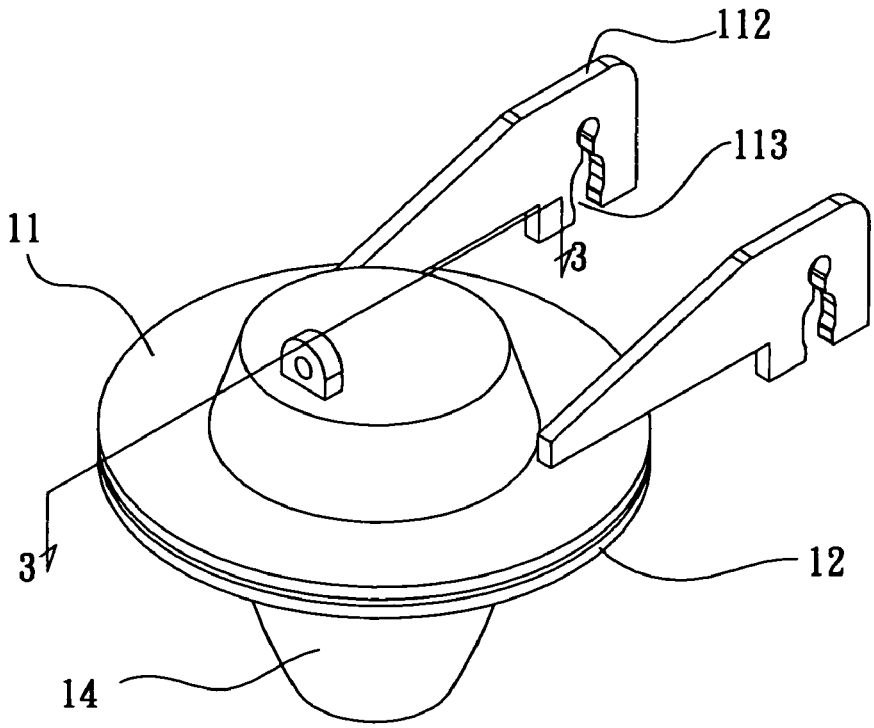
FIG. 2 is an assembled view of the drain valve of FIG. 1.
Figure 3:
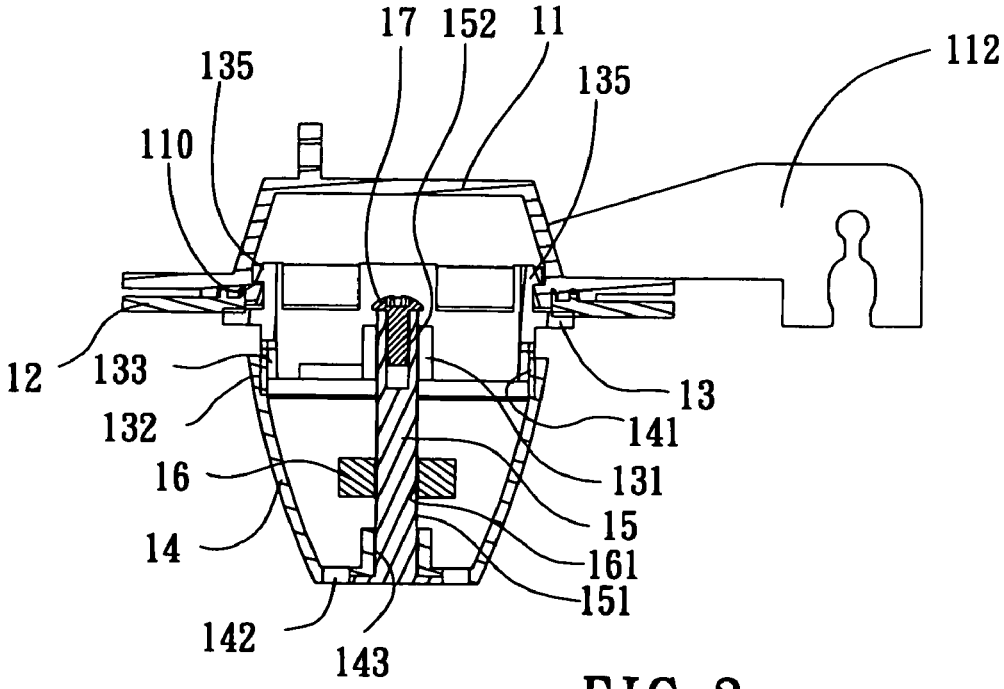
FIG. 3 is a cross-sectional view taken along line 3-3 of FIG. 2.

The fixing base 13 is made of plastic and is shaped of a ring. A hollow post 131 extends through a center of the fixing base 13. The fixing base 13 forms outer screw threads 132 on an outer peripheral of a lower portion thereof. A plurality of substantially arcuate vent holes 133 is distributed at an outer peripheral of a bottom of the fixing base 13. A plurality of flanges 134 extends upwardly from an inner edge of the fixing base and is distributed apart the same distance from each other. Each flange 134 forms an anchor 135 outwardly for positioning the fixing base 13 onto the positioning flat 110 of the cover 11 and retaining the stop pad 12 between the cover 11 and the fixing base 13 (as shown in FIG. 3). The float 14 is hollow and generally tapered, and defines inner screw threads 141 on an inner peripheral of an upper portion thereof for engaging with the outer screw threads 132 of the fixing base 13 thereby adjusting width of the vent holes 133 freely. A plurality of flow holes 142 is defined at a bottom of the float 14 for allowing water in or out. A through hole 143 is defined in a center of a bottom of the float 14. The fixing axis 15 extends through the through hole 143 of the float 14 and forms axis outer threads 151 on an outer peripheral thereof. The weight block 16 forms block inner threads 161 on an inner peripheral thereof for engaging with the axis outer threads 151 of the fixing axis 15. The fixing axis 15 further forms axis inner threads 152 near a top thereof. In assembly, the fixing axis 15 extends through the through hole 143 of the float 14 and the hollow post 131 of the fixing base 13, and the bolt 17 engages with the axis inner threads 152 of the fixing axis 15 (as shown in FIG. 3).

The drain valve 10 is mounted interior the water tank 20. When a toilet bowl (not shown) needs to be flushed, the handle 22 is activated to drive the link pole 23, and sequentially the chain 21 is pulled upward and opens the drain valve 10. Meanwhile preserved water in the water tank 20 flows out from the drain hole 25 (referring to FIG. 7) for flushing the toilet bowl.

During preserved water in the water tank 10 flows out of the drain hole 25, water also flows through the flow holes 142 and into the float 14. Due to air is lighter than water, air in the float 14 is pulled out from the vent holes 133 of the fixing base 13 by the water.

When preserved water in the water tank 20 flows out at a predetermined value, weight of water in the float 14 reaches a predetermined value. Meanwhile the cover 11 pivots and stops the drain hole 25 (referring to FIG. 6), and water directly flows out of the float 14 from the flow holes 142. The Water tank 20 begins to preserve water therein for next use.

Referring to FIGS. 4 and 5, a user may directly adjust the float 14 with respect to the outer screw threads 132 of the fixing base 13 for controlling width of the vent holes 133 and interior room of the float 14. As shown in FIG. 4, when the float 14 moves upwardly relative to the outer screw threads 132 and entirely covers the vent holes 133, the float 14 floats in the water and air in the float 14 can not let out from the vent holes 133. Thus draining time of the drain valve 10 is lengthened. As shown in FIG. 5, when the float 14 moves downwardly relative to the outer screw threads 132, width of the vent holes 133 increases. More room in the float 14 is provided for reserving water gradually. When the vent holes 133 are relatively smaller, air runs out of the float 14 more slowly, and relatively larger floating force is formed, shortening draining time of the drain valve 10, in other words, lengthening stopping time of the drain valve 10. When the vent holes 133 become relatively larger, air runs out of the float 14 more quickly, and more water flows into the float 14, which makes the cover 11 pivots downwardly to stop water of the water tank 20, thereby appropriately controlling stopping time of the cover 11 for saving water.

The float 14 cooperates with the fixing base 13 by the fixing axis 15 and the bolt 17. The float 14 moves with respect to the outer screw threads 132 of the fixing base 13, therefore avoiding disengaging from the fixing base 13.

The weight block 16 engages with the fixing axis 15 by screw threads. When the weight block 16 is at an upper portion of the fixing axis 15, the float 14 is relatively lighter, lengthening stopping time of the drain valve 10. When the weight block 16 is at a lower portion of the fixing axis 15, the float 14 is relatively heavier, shortening stopping time of the drain valve 10. So the weight block 16 assists the cover 11 to control water draining time and stopping time and facilitates to reduce water consumption.

In other embodiment, the fixing base 13 and the float 14 may be adjusted in other ways, for instance, by a latch for adjusting width of the vent holes 133.

It is understood that the invention may be embodied in other forms without departing from the spirit thereof. Thus, the present examples and embodiments are to be considered in all respects as illustrative and not restrictive, and the invention is not to be limited to the details given herein.

The invention claimed is:

1. A drain valve, which is assembled on a rotating element of a water tank and is adapted to cooperate with a handle and a link element of the water tank for controlling opening or stopping a drain hole of the water tank, comprising:

a fixing base forming outer screw threads on an outer peripheral of a lower portion thereof, a plurality of vent holes being distributed at an outer peripheral of a bottom of the fixing base, a plurality of flanges extending upwardly from an inner edge of the fixing base, wherein each flange forms an anchor outwardly;

a cover assembled on the anchors of the fixing base and having an inner surface and an outer surface, wherein a positioning flat being formed at the inner surface, a lift portion projecting at the outer surface and connecting with the link element of the water tank, and at least one support arm being formed at the outer surface for mounting on the rotating element of the water tank;

a stop pad arranged between the cover and the fixing base; and a float being hollow and generally tapered, and defining inner screw threads on an inner peripheral of an upper portion thereof for engaging with the outer screw threads of the fixing base whereby rotation of said float with respect to said fixing base, about said outer and inner screw threads, will adjust the amount of said vent holes that is exposed to an exterior of said valve, a plurality of flow holes being defined at a bottom of the float for allowing water in or out.

2. The drain valve as claimed in claim 1, further comprising a fixing axis, a weight block and a bolt, wherein the fixing axis extends through the float and a center of the fixing base in assembly, and forms axis inner threads at a top thereof for engaging with the bolt, and wherein the weight block is assembled on the fixing axis.

3. The drain valve as claimed in claim 2, wherein a hollow post extends through a center of the fixing base, and wherein the fixing axis extends through the hollow post of the fixing base in assembly.

4. The drain valve as claimed in claim 2, wherein a through hole is defined in a center of a bottom of the float, and wherein the fixing axis extends through the through hole of the float in assembly.

5. The drain valve as claimed in claim 2, wherein the weight block forms block inner threads, and the fixing axis forms axis outer threads on an outer periphery thereof for engaging with block inner threads of the weight block.

6. The drain valve as claimed in claim 1, wherein said at least one support arm comprises a pair of parallel support arms that extend beyond the cover, and wherein each support arm defines a notch at a bottom thereof for clamping the rotating element of the water tank.

7. The drain valve as claimed in claim 1, wherein the vent holes are substantially arcuate.

* * * * *